US007357623B2

(12) United States Patent
Leghzaouni et al.

(10) Patent No.: US 7,357,623 B2
(45) Date of Patent: Apr. 15, 2008

(54) ANGLED COOLING DIVIDER WALL IN BLADE ATTACHMENT

(75) Inventors: Othmane Leghzaouni, Longueull (CA); Ghislain Plante, Boucherville (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 351 days.

(21) Appl. No.: 11/134,344

(22) Filed: May 23, 2005

(65) Prior Publication Data

US 2006/0263218 A1 Nov. 23, 2006

(51) Int. Cl.
*F01D 5/18* (2006.01)

(52) U.S. Cl. ..... 416/97 R

(58) Field of Classification Search ..... 415/115; 416/95, 97 R, 248
See application file for complete search history.

(56) References Cited

U.S. PATENT DOCUMENTS 3,014,693 A 12/1961 Horne
3,044,745 A 7/1962 Stark
3,164,367 A 1/1965 Lynch
3,738,771 A 6/1973 Delarbre et al.
3,982,852 A 9/1976 Andersen et al.
4,314,007 A 2/1982 Gessinger
4,820,123 A 4/1989 Hall
5,002,460 A 3/1991 Lee et al.
5,674,050 A * 10/1997 Hall et al. ..... 416/97 R
5,980,209 A 11/1999 Barry et al.
6,019,579 A 2/2000 Fukuno et al.
6,132,174 A * 10/2000 Staub et al. ..... 416/96 R
6,565,318 B1 * 5/2003 Tiemann ..... 416/97 R

* cited by examiner

*Primary Examiner*—Edward K. Look
*Assistant Examiner*—Devin Hanan
(74) *Attorney, Agent, or Firm*—Ogilvy Renault LLP

(57) ABSTRACT

A rotor blade of a gas turbine engine includes a blade root defining a cooling airflow entry cavity therein, in fluid communication with internal cooling air passages through the blade. The cavity includes opposed side walls and at least one divider wall extending therebetween. At least one end portion of the divider walls adjoins one of the side walls in an angled direction relative to a perpendicular direction of the side walls.

15 Claims, 4 Drawing Sheets

ANGLED COOLING DIVIDER WALL IN BLADE ATTACHMENT

TECHNICAL FIELD

The invention relates generally to gas turbine engines, and more particularly to a cooled turbine rotor assembly.

BACKGROUND OF THE ART

A conventional gas turbine engine includes various rotor blades in the fan, compressor, and turbine sectors thereof, which are removably mounted to respective rotor discs. Each of the rotor blades includes a blade root at the radially inner end thereof. Each of the blade roots conventionally includes one or more pairs of lobes which can axially slide into and be retained in one of a plurality of axially extending attachment slots in the periphery of the rotor disc, thereby forming the attachment of the rotor blade. In a cooled turbine rotor assembly, the attachment or blade root of each rotor blade defines a cooling air entry cavity therein for receiving cooling air and bringing cooling air into the airfoil of the rotor blade for cooling same. In order to maintain the structural stiffness of the attachment, a given number of divider walls or ribs extending within the cavity is usually required because a centrifugal load which is born by the blade attachment, is generated as the blade rotates around the main engine axis. Nevertheless, conventional divider walls or ribs have limited effect. The centrifugal load generated by the high rotational speed of the rotor assembly results in not only large compressive stresses on the ribs, but also buckling and shear effects which can initiate cracks in the blade attachment structure.

Accordingly, there is a need to provide an improved blade root structure for cooled turbine rotor assemblies of gas turbine engines in order to meet the demanding requirements of various aspects of high efficiency gas turbine engines.

SUMMARY OF THE INVENTION

It is therefore an object of the present invention to provide an improved blade attachment structure for a rotor assembly of a gas turbine engine.

In one aspect, the present invention provides a rotor blade having internal cooling air passages for a gas turbine engine, which comprises an airfoil section defining the cooling air passages therethrough, a blade root having at least one side projection on each of opposed sides thereof extending between leading and trailing ends of the blade root, and platform segments extending laterally from opposed sides of the airfoil section. The blade root defines a cavity therein with an opening thereof in a bottom of the blade root. The cavity is in fluid communication with the cooling air passages through the airfoil section. The cavity includes opposed side walls substantially parallel to a main longitudinal axis of the blade root and at least one divider wall extending from the opening inwardly into the cavity and extending between the side walls. At least one end portion of the divider wall adjoins one of the side walls in an angled direction relative to a perpendicular direction of the side walls.

In another aspect, the present invention provides a turbine rotor assembly for a gas turbine engine, which comprises a rotor disc defining a plurality of attachment slots circumferentially spaced apart one from another and extending axially through a periphery thereof, and an array of rotor blades extending outwardly from the periphery of the rotor disc. Each of the rotor blades includes an airfoil section defining internal cooling air passages therethrough, a blade root affixed within the attachment slots of the rotor disc, and platform segments extending laterally from sides of the airfoil section into opposing relationship with corresponding platform segments of adjacent rotor blades. Each of the blade roots defines a cavity therein with an opening thereof in a bottom of the blade root and in fluid communication with the cooling air passages, and includes means defined within the cavity for reducing a torsion effect on the blade root resulting from a rotational speed of the turbine rotor assembly during engine operation, thereby stiffening the blade root.

In another aspect, the present invention provides a turbine rotor assembly for a gas turbine engine, which comprises a rotor disc and an array of rotor blades extending outwardly from a periphery of the rotor disc. The rotor disc defines a plurality of attachment slots circumferentially spaced apart one from another. Each of the attachment slots together with at least one pair of side recesses in respective side walls of the attachment slot, extends axially and circumferentially through the periphery thereof. Each of the rotor blades includes an airfoil section defining internal cooling air passages therethrough, a blade root having at least one side projection on each of opposed sides thereof affixed in one attachment slot of the rotor disc, and platform segments extending laterally from sides of the airfoil section into opposing relationship with corresponding platform segments of adjacent rotor blades. Each of the blade roots further defines a cavity therein with an opening in a bottom of the blade root and in fluid communication with the cooling air passages. The cavity includes opposed side walls substantially parallel to the attachment slot receiving the blade root. At least one divider wall extends from the opening inwardly into the cavity and extends between the side walls in an angled direction relative to a perpendicular direction of the side walls.

Further details of these and other aspects of the present invention will be apparent from the detailed description and figures included below.

DESCRIPTION OF THE DRAWINGS

Reference is now made to the accompanying drawings depicting aspects of the present invention, in which.

DETAILED DESCRIPTION OF THE PREFERRED EMBODIMENTS

Figure 1:
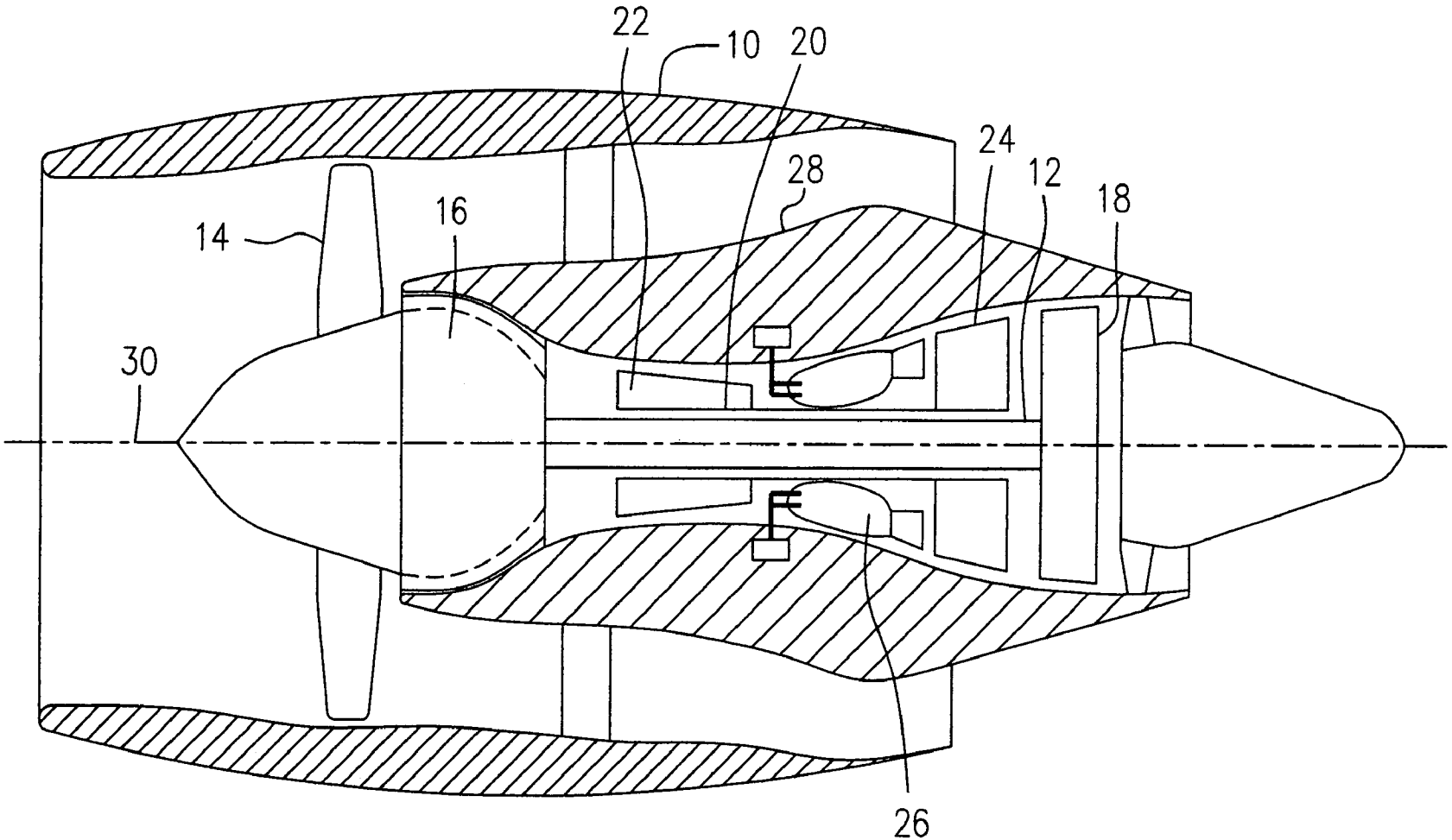
FIG. 1 is a schematic cross-sectional view of a turbofan gas turbine engine which illustrates an exemplary application of the present invention.

A turbofan engine illustrated schematically in FIG. 1, presented as an example of the application of the present invention, includes a housing or nacelle 10, a low pressure spool assembly seen generally at 12 which includes a fan 14, a low pressure compressor 16 and a low pressure turbine 18, a high pressure spool assembly seen generally at 20 which includes a high pressure compressor 22 and a high pressure turbine 24. A core casing 28 surrounds the low and high pressure spool assemblies 12 and 20 to define a main fluid path (not indicated) therethrough. In the main fluid path there is provide a combustor seen generally at 26 with fuel injecting means (not indicated) to constitute a gas generator section. The compressors 16 and 22 drive a main airflow (not indicated) along the main fluid path and provide bleed airflow as a cooling air source for cooling the combustor 26 as well as the turbines 18 and 24.

It should be noted that similar components of the different embodiments shown in the accompanying Figures are indicated by similar numerals for convenience of description of the present invention. Only those components different in one embodiment from the other will be separately described with reference to additional numerals.

Figure 2:
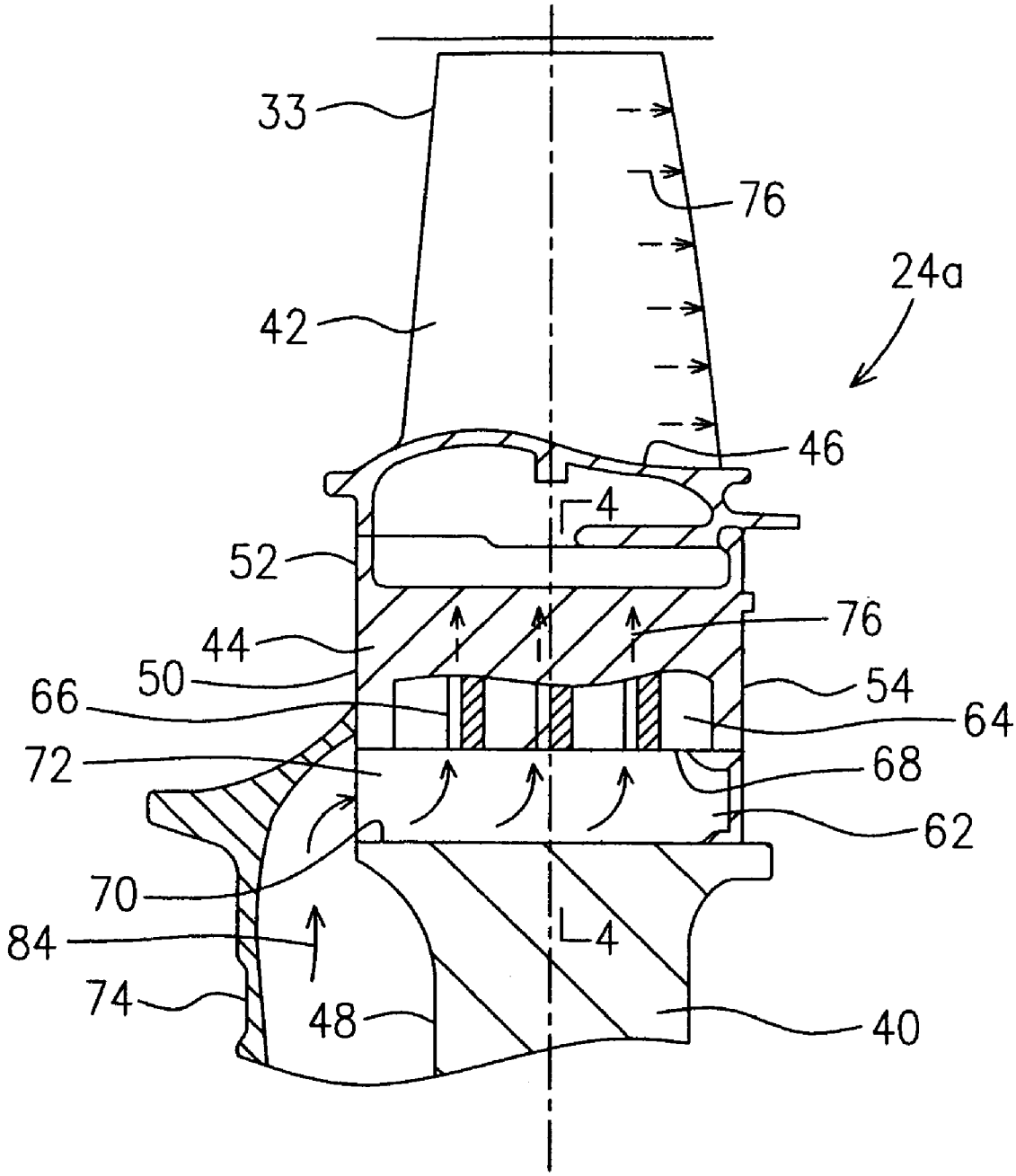
FIG. 2 is a partial cross-sectional view of the gas turbine engine of FIG. 1, illustrating one embodiment of the present invention.

Referring to FIGS. 1 and 2, a rotor assembly, for example, a turbine rotor assembly 24*a* of the high pressure turbine 24 is described herein according to one embodiment of the present invention. The turbine rotor assembly 24*a* includes a turbine rotor disc 40 mounted to a rotating shaft (not indicated) of the high pressure spool assembly 20 and is rotatable about a main longitudinal axis 30 of the engine. An array of rotor blades 33 (only one shown in FIG. 2) extend outwardly from a periphery of the turbine rotor disc 40. Each of the rotor blades 33 includes an airfoil section 42, a root section 44 and platform segments 46 extending laterally from opposed sides of the airfoil section 42 into opposing relationship with corresponding platform segments of adjacent rotor blades (not shown).

The rotor assembly 24*a* is now described in greater detail with reference to FIGS. 1-6. The turbine rotor disc 40 includes a web section 48 extending radially outwardly from a hub (not shown) mounted to the rotating shaft (not indicated) of the high pressure spool assembly 20 of FIG. 1, and a rim section 50 extending radially outwardly from the web section 48. Rim section 50 has an axial thickness defined between a front face 52 and a rear face 54.

Figure 4:
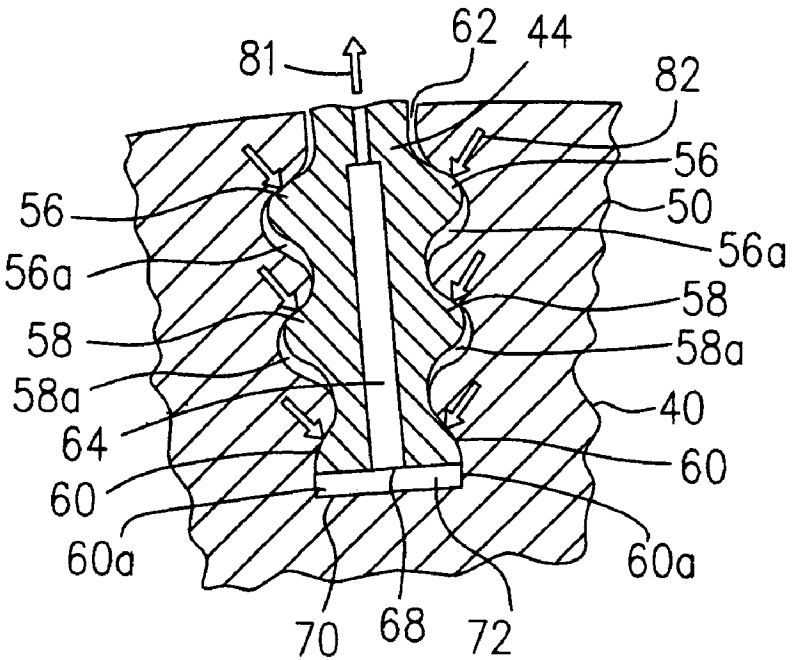
FIG. 4 is a partial cross-sectional view of the turbine rotor assembly taken along line 4-4 in FIG. 2, illustrating the centrifugal load and the resulting compressive stresses on the blade attachment.

The root section 44 of each turbine rotor blade 33 includes at least one projection on each of opposed sides thereof, which in this embodiment are, for example, formed by a series of lobes 56, 58 and 60, having decreasing circumferential widths from the radially outermost lobe 56 to the radially innermost lobe 60, with the radially central lobe 58 disposed therebetween and having an intermediate lobe width (See FIG. 4). The root section 44 of such a multi-lobed. type is often referred to as a firtree, because of this characteristic shape. The root section 44 is adapted for attachment to the rotor disc 40 and therefore is generally referred to as a blade attachment.

For aerodynamic benefits, each of the blades 33 is preferably positioned in an angled direction relative to the main axis 30 of the engine. The angle between the angled direction of the blade 33 and the main axis 30 of the engine is referred to as a broach angle B hereinafter throughout the description and appended claims of this application. Therefore, a main longitudinal axis 32 of the root section 44 extends in a direction of a broach angle B relative to the main axis 30 of the engine. The at least one projection on each of opposed sides of the root section 44 or the lobes 56, 58 and 60, extend between leading and trailing ends 34, 36 of the root section 44 and are substantially parallel to the main longitudinal axis 32 of the root section 44.

The turbine rotor disc 40 further includes a plurality of attachment slots 62 (only one shown) circumferentially spaced apart one from another and extending axially and circumferentially in an angled direction of the broach angle B relative to the main axis 30 of the engine, through the periphery of the turbine rotor disc 40 which is the entire axial thickness of the rim 50 in this embodiment. Each axial attachment slot 62 includes a series of axial recesses or fillets 56*a*, 58*a* and 60*a* defined in opposed side walls (not indicated) of attachment slot 62, which substantially conform in both shape and direction to the firtree of root section 44, so as to form abutting returning surfaces of the respective root section 44 and attachment slot 62 for retaining rotor blade 33 in the turbine rotor assembly 24*a* under the high temperature, high stress environment of the rotating turbine. The abutting retaining forces will be further described in detail hereinafter.

The turbine rotor blade 33 preferably further includes internal cooling airflow passages which are not shown but are indicated by broken line arrows 76, for directing pressurized cooling airflow through the airfoil section 42 of the turbine rotor blades 33, and discharging same through a plurality of openings 78 on the trailing edge 80 of the airfoil section 42, into the gas path, and/or through a plurality of openings called film holes/slots (see FIG. 3, not indicated) on the airfoil side walls (not indicated) at the airfoil section 42 into the gas path. In particular, the root section 44 defines a cooling air entry cavity 64 therein with an opening (not indicated) thereof in a bottom 68 of the root section 44 and in fluid communication with the cooling airflow passages 76 through the airfoil section 42. The cavity 64 includes opposed side walls 63 substantially parallel to the main longitudinal axis 32 of the root section 44. The cavity 64 further includes at least one divider wall, but preferably a plurality of divider walls 66 extending from the opening inwardly into the cavity 64 and extending between the side walls 63. At least one end portion of the divider wall 66 adjoins one of the side walls 63 in an angled direction relative to a perpendicular direction of the side walls 63. The angled direction is indicated by the angle A in FIG. 6. In this embodiment, the entire divider wall 66 extends between the opposed side walls 63 in the angled direction indicated by the angle A. Therefore, the cooling air entry cavity 64 receives a pressurized cooling airflow (indicated by arrow 84) which is delivered from a pressurized cooling air source (not shown) such as bleed air from compressor assembly 16 or 22. The cooling airflow 84 is guided between a front cover plate 74 and turbine rotor disc 40, and is then directed into a space 72 defined between the bottom 68 of the root section 44 and a bottom 70 of the attachment slot 62. The cooling air entry cavity 64 further directs the received cooling airflow through the passages defined by the divider walls 66 therein into the inner cooling airflow passages 76 within the airfoil section 42 to cool the rotor blade 33.

Figure 5:
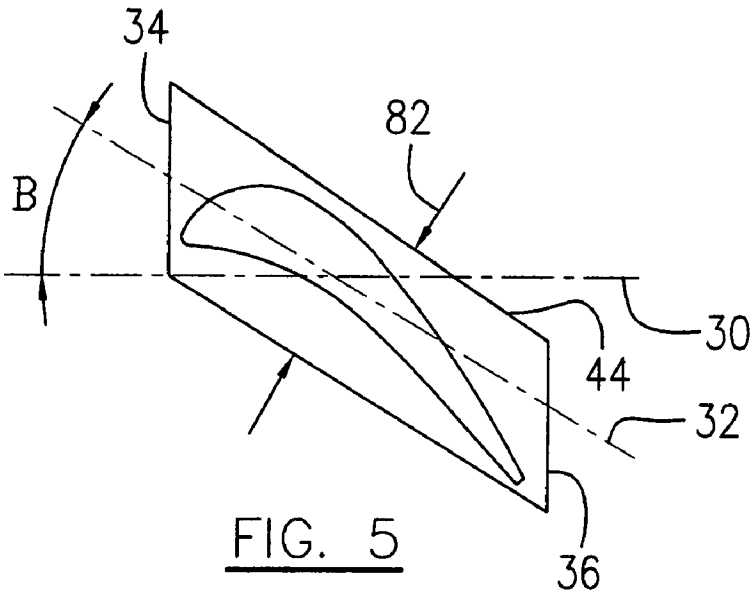
FIG. 5 is a schematic top plane view of the rotor blade of FIG. 3 without showing the platform thereof, illustrating a broach angle between the main longitudinal axis of the blade attachment and the main axis of the gas turbine engine.
Figure 6:
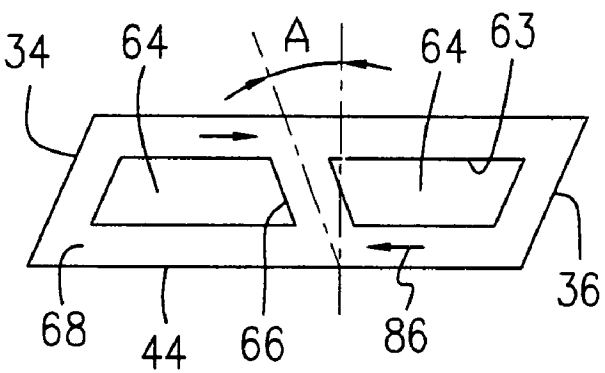
FIG. 6 is a simplified schematic bottom plane view of the rotor blade of FIG. 3, illustrating the relationship between the angled direction of the divider wall (only one shown) and the torsion effect on the blade attachment.

Particularly referring to FIGS. 4-6, the centrifugal load indicated by arrow 81, on the root section 44, caused by the rotational speed of the rotor assembly 24*a* of FIG. 2, produces retaining forces on the projections or the lobes 56, 58 and 60 of the root section 44, as indicated by arrows 82. The retaining forces 82 include radial components which counter the centrifugal load 81, and circumferential components resulting in high compressive stresses on the root section 44. Therefore, divider walls 66 are used within the cavity 64 against the compressive stresses, in order to stiffen the hollow structure of the root section 44.

Nevertheless, the centrifugal load 81 caused by the rotational speed of the rotor assembly 24 of FIG. 2 not only causes compressive stresses by traction effect but also further results in a torsion effect on the root section 44, as indicated by a pair of arrows 86 in FIG. 6, which can create shear effects on a conventional divider wall (as shown by broken lines in FIG. 6) which extends between the opposed side walls 63 of the cavity 64 in a perpendicular direction. A wall or rib reinforcing element can effectively bear a compressive load but is much less effective for bearing a torsional load. The broaching angle of the root section 44 will further increase the torsion effect caused by the rotational speed of the rotor assembly 24*a* (see FIG. 2). Therefore, in accordance with one embodiment of the present invention, the divider wall 66 extends in an angled direction relative to the perpendicular direction of the side walls 63 of the cavity 64. Thus, the torsion effect caused by the rotational speed of the rotor assembly 24*a* of FIG. 2 creates more compressive load on the divider wall 66 and less shear loads on same, in contrast to the torsion effect on the conventional divider wall perpendicularly adjoining the side walls 63 of the cavity 64, thereby more effectively stiffening the hollow structure of the root secton 44.

Figure 7:
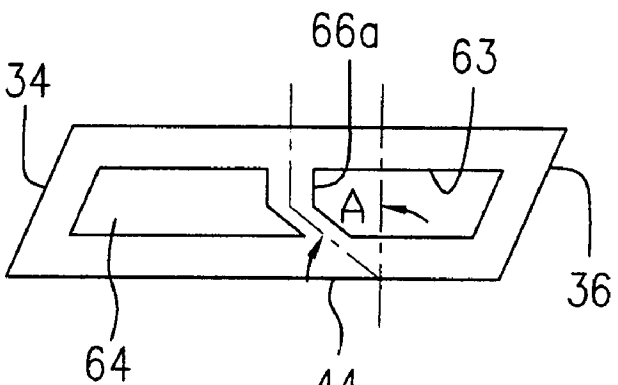
FIG. 7 is a schematic view similar to that of FIG. 6, illustrating an angled divider wall according to a further embodiment of the present invention.

FIG. 7 illustrates a further embodiment of the present invention in which the divider wall 66*a* is itself angled, in contrast to the flat configuration of the divider wall 66 of FIG. 6. The divider wall 66*a* has only one end portion adjoining one of the side surfaces 63 in the angled direction of angle A relative to the perpendicular direction of the side walls 63. The other end of the divider wall 66*a* adjoins the other of the side walls 63 perpendicularly.

Figure 8:
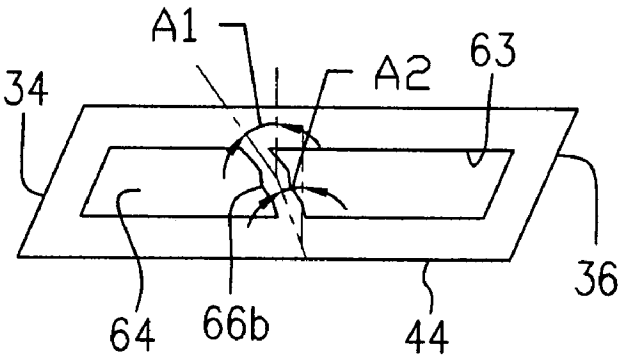
FIG. 8 is a schematic view similar to that of FIG. 6, illustrating a multiple angled divider wall according to a still further embodiment of the present invention.

FIG. 8 illustrates a still further embodiment of the present invention, in which the divider wall 66*b* has a first end portion thereof adjoining one of the side walls 63 in a first angled direction of angle A1 and a second end portion thereof adjoining the other of the side walls 63 in a second angled direction of angle A2, relative to the perpendicular direction of the side walls 63. As an example of the present invention, the illustrated divider wall 66*b* includes a middle portion (not indicated) interconnecting the first and second end portions of the divider wall 66*b*, the angles A1 and A2 being different. Alternatively, angles A1 and A2 of respective first and second end portions of divider wall 66*b*, could be equal. Also alternatively, angles A1 and A2 could be different, with the first second end portions connected to each other directly, without a middle portion therebetween.

Figure 3:
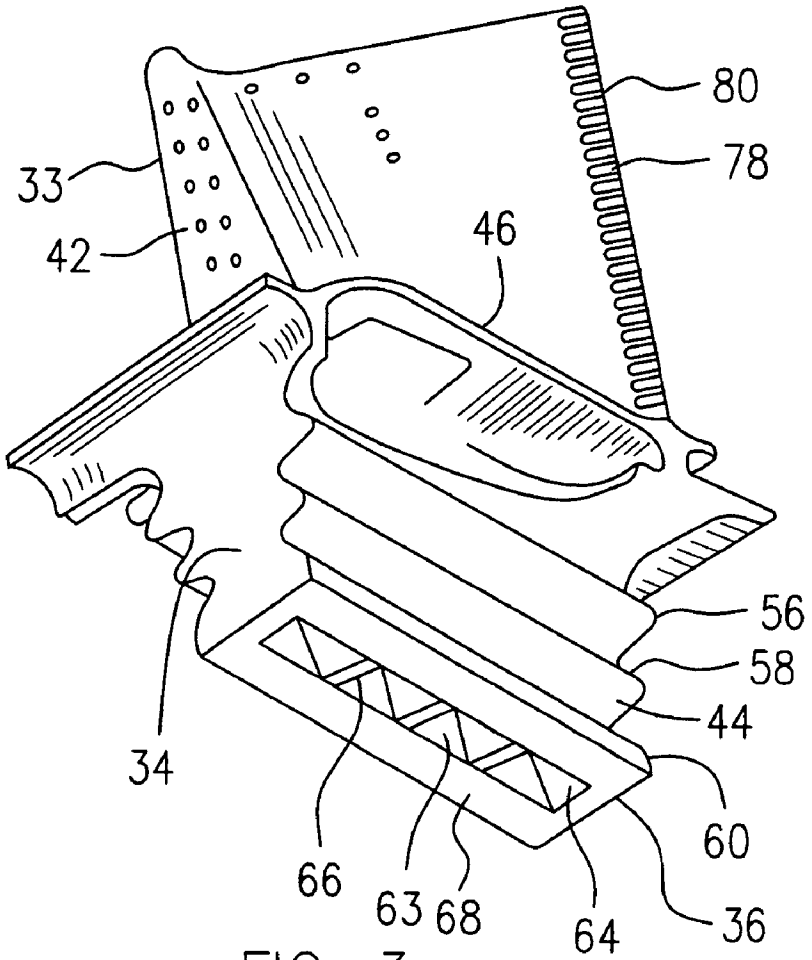
FIG. 3 is a perspective view of the turbine rotor blade of FIG. 2, illustrating a blade attachment defining a cooling air entry cavity therein with angled divider walls in the cavity.

Referring now to FIGS. 2 and 3, as a secondary effect, the angled orientation of the divider wall 66 is beneficial to the cooling flow 84 into the internal cooling passages 76 of the airfoil, by reducing pressure loss when the cooling air flow 84 enters the cooling air entry cavity 64. With a more appropriate feed pressure, blade durability can be improved or the required quantity of airfoil cooling airflow can be reduced, thereby improving engine performance.

The above description is meant to be exemplary only, and one skilled in the art will recognize that changes may be made to the embodiments described without department from the scope of the invention disclosed. For example, the divider walls can be configured differently from those described, provided that at least one end portion thereof adjoins one of the side walls of the cavity in angled direction relative to the perpendicular direction of the side walls of the cavity. Still other modifications which fall within the scope of the present invention will be apparent to those skilled in the art, in light of a review of this disclosure, and such modifications are intended to fall within the appended claims.

The invention claimed is:

1. A rotor blade having internal cooling air passages for a gas turbine engine, comprising:

an airfoil section defining the cooling air passages therethrough, a blade root having at least one side projection on each of opposed sides thereof extending between leading and trailing ends of the blade root, and platform segments extending laterally from opposed sides of the airfoil section; and the blade root defining a cavity therein with an opening thereof in a bottom of the blade root and in fluid communication with the cooling air passages through the airfoil section, the cavity including opposed side walls substantially parallel to a main longitudinal axis of the blade root and at least one divider wall extending from the opening inwardly into the cavity and extending between the side walls, at least one end portion of the divider wall adjoining one of the side walls in an angled direction relative to a perpendicular direction of the side walls.

2. The rotor blade as defined in claim 1 wherein the divider wall comprises a first end portion thereof adjoining one of the side walls in a first angled direction and a second end portion thereof adjoining the other of the side walls in a second angled direction relative to the perpendicular direction of the side walls.

3. The rotor blade as defined in claim 2 wherein the first and second angled directions are substantially superposed.

4. The rotor blade as defined in claim 3 wherein the superposed angled directions of the divider wall relative to the perpendicular direction of the side walls are determined by a rotational direction of the engine.

5. The rotor blade as defined in claim 1 wherein the main longitudinal axis of the blade root defines a broach angle relative to a main axis of the engine when the rotor blade is installed in a rotor assembly of the engine.

6. The rotor blade as defined in claim 5 wherein an angle between the angled direction of the one end portion of the divider wall and the perpendicular direction of the side walls, is substantially equal to the broach angle.

7. The rotor blade as defined in claim 1 wherein the blade root comprises a plurality of lobes defined on the opposed sides thereof, extending in an angled direction relative to a main axis of the engine.

8. An turbine rotor assembly for a gas turbine engine comprising:

a rotor disc defining a plurality of attachment slots circumferentially spaced apart one from another and extending axially through a periphery thereof;

an array of rotor blades extending outwardly from the periphery of the rotor disc, each of the rotor blades including an airfoil section defining internal cooling air passages therethrough, a blade root affixed within the attachment slots of the rotor disc, and platform segments extending laterally from sides of the airfoil section into opposing relationship with corresponding platform segments of adjacent rotor blades; and each of the blade roots defining a cavity therein with an opening thereof in a bottom of the blade root and in fluid communication with the cooling air passages, at least one divider wall extending between opposed side walls of the cavity and extending inwardly from the opening of the cavity, the side walls being substantially parallel to a main longitudinal axis of the blade root, and at least one end portion of the divider wall adjoining one of the side walls in an angled direction relative to a perpendicular direction of the side walls.

9. The turbine rotor assembly as defined in claim 8 wherein the angled direction of the one end portion of the divider wall is determined by a rotational direction of the turbine rotor assembly.

10. The turbine rotor assembly as defined in claim 8 wherein the entire divider wall extends between the opposed side walls in the angled direction relative to the perpendicular direction of the side walls.

11. The turbine rotor assembly as defined in claim 10 wherein each of the attachment slots of the rotor disc and the blade root affixed therein, extend axially and circumferentially in an angled direction relative to a main axis of the engine, thereby defining a broach angle between the blade root and the main axis of the engine.

12. The turbine rotor assembly as defined in claim 11 wherein each of the attachment slots of the rotor disc comprises a plurality of pairs of recesses defined in opposed side walls of the attachment slot, extending through the periphery of the rotor disc, and wherein each of the blade roots comprises a plurality of pairs of side projections on opposed sides thereof corresponding to and received in the respective pairs of recesses of the attachment slot.

13. The turbine rotor assembly as defined in claim 11 wherein an angle between the angled direction of the divider wall and the perpendicular direction of the side walls are substantially equal to the broach angle.

14. The turbine rotor assembly as defined in claim 8 wherein the divider wall comprises a first end portion thereof adjoining one of the side walls in a first angled direction and a second end portion adjoining the other of the side walls in a second angled direction relative to the perpendicular direction of the side walls.

15. A turbine rotor assembly for a gas turbine engine, comprising:

a rotor disc defining a plurality of attachment slots circumferentially spaced apart one from another, each of the attachment slots together with at least one pair of side recesses in respective side walls of the attachment slot, extending axially and circumferentially through a periphery thereof;

an array of rotor blades extending outwardly from the periphery of the rotor disc, each of the rotor blades including an airfoil section defining internal cooling air passages therethrough, a blade root having at least one side projection on each of opposed sides thereof affixed in one attachment slot of the rotor disc, and platform segments extending laterally from sides of the airfoil section into opposing relationship with corresponding platform segments of adjacent rotor blades; and each of the blade roots defining a cavity therein with an opening in a bottom of the blade root and in fluid communication with the cooling air passages, and the cavity including opposed side walls substantially parallel to the attachment slot receiving the blade root, and at least one divider wall extending from the opening inwardly into the cavity, and extending between the side walls in an angled direction relative to a perpendicular direction of the side walls.

* * * * *